US005467173A

United States Patent [19]

Sakata et al.

[11] Patent Number: 5,467,173

[45] Date of Patent: Nov. 14, 1995

[54] SPEED CONTROL CIRCUIT FOR AN OPTICAL SCANNING SYSTEM DRIVING MOTOR FOR AN IMAGE FORMING APPARATUS

[75] Inventors: Satoshi Sakata; Tomoo Kudo; Hiroyuki Watanabe; Tadashi Matsudaira, all of Hachioji, Japan

[73] Assignee: Konica Corporation, Tokyo, Japan

[21] Appl. No.: 189,503

[22] Filed: Jan. 31, 1994

[30] Foreign Application Priority Data

| | | | |
|---|---|---|---|
| Feb. 5, 1993 | [JP] | Japan | 5-042149 |
| Feb. 5, 1993 | [JP] | Japan | 5-042150 |
| Feb. 5, 1993 | [JP] | Japan | 5-042151 |
| Feb. 5, 1993 | [JP] | Japan | 5-042152 |

[51] Int. Cl.[6] ..... G03G 15/00

[52] U.S. Cl. ..... 355/235; 318/696; 347/234; 347/235; 355/233

[58] Field of Search ..... 355/233, 235, 355/228; 347/250, 235, 133, 234; 364/400; 388/827, 826, 838; 318/690, 696

[56] References Cited

U.S. PATENT DOCUMENTS

| | | | |
|---|---|---|---|
| 4,146,908 | 3/1979 | Vandling | 358/275 |
| 4,218,735 | 8/1980 | McCutcheon | 364/400 |
| 4,568,171 | 2/1986 | Ikenoue | 355/235 |
| 4,605,884 | 8/1986 | Miyagi | 388/820 |
| 4,635,000 | 1/1987 | Swanberg | 331/10 |
| 4,733,308 | 3/1988 | Nakamura et al. | 358/288 |
| 4,862,512 | 8/1989 | Hidaka et al. | 382/58 |
| 4,870,448 | 9/1989 | Miyake et al. | 355/235 |
| 4,990,763 | 2/1991 | Shinada | 250/205 |
| 5,097,189 | 3/1992 | Ito et al. | 318/685 |
| 5,260,811 | 11/1993 | Morikawa | 358/474 |
| 5,266,787 | 11/1993 | Mazz et al. | 235/467 |

FOREIGN PATENT DOCUMENTS 63-69476 3/1988 Japan .

*Primary Examiner*—A. T. Grimley
*Assistant Examiner*—Thu A. Dang
*Attorney, Agent, or Firm*—Frishauf, Holtz, Goodman, Langer & Chick

[57] ABSTRACT

A speed controlling circuit for controlling an optical scanning system driving motor in use with an image forming apparatus such as a copier and a printer. The speed controlling circuit includes; an encoder for generating pulse signals according to a rotation of the optical scanning system driving motor; a generating circuit for generating reference clock signals; a first memory for storing a first set of numbers for dividing a frequency of the pulse signals; a second memory for storing a second set of numbers corresponding to a target rotation speed of the optical scanning system driving motor; a first setting circuit and a second setting circuit for respectively reading one of the first set of numbers from the first memory and one of the second set of numbers from the second memory, and for setting those numbers at every predetermined interval time while the optical scanning system driving motor is accelerating or decelerating; a frequency-dividing circuit for dividing the frequency of the pulse signals according to the set number of the first set of numbers; a detecting circuit for detecting a rotating speed of the optical scanning system driving motor according to the reference signals and pulse signals at every frequency period which is divided by the frequency-dividing circuit; a comparator circuit for comparing the rotating speed, detected by the detecting circuit, with the set number of the second set of numbers at every frequency period which is divided by the frequency-dividing circuit; and a control circuit for controlling the rotating speed of the optical scanning system driving motor according to a result of the comparing of the comparator circuit.

20 Claims, 11 Drawing Sheets

TIMER INTERRUPTION PROCESSING(1)

FIG. 4 TIMER INTERRUPTION PROCESSING(2)

FIG. 5 TIMER INTERRUPTION PROCESSING(3)

A CASE OF ONE FREQUENCY-DIVIDING OPERATION

PULSE SIGNALS OUTPUTTED FROM AN ENCODER 105

COINCIDENCE SIGNALS OUTPUTTED FROM A COMPARATOR 110

CLOCK PULSES OUTPUTTED FROM A CLOCK PULSE GENERATOR

COUNTED CLOCK PULSE NUMBER OUTPUTTED FROM A LATCH CIRCUIT 106

A CASE OF TWO FREQUENCY-DIVIDING OPERATIONS

PULSE SIGNALS OUTPUTTED FROM THE ENCODER 105

COINCIDENCE SIGNALS OUTPUTTED FROM THE COMPARATOR 110

CLOCK PULSES OUTPUTTED FROM THE CLOCK PULSE GENERATOR

COUNTED CLOCK PULSE NUMBER OUTPUTTED FROM THE LATCH CIRCUIT 106

SPEED CONTROL CIRCUIT FOR AN OPTICAL SCANNING SYSTEM DRIVING MOTOR FOR AN IMAGE FORMING APPARATUS

BACKGROUND OF THE INVENTION

The present invention relates to a speed control circuit for an optical scanning system driving motor for an image forming apparatus.

As an example of the image forming apparatus, a plurality of motors for driving a photoreceptor drum, an optical scanning system, a fixing roller, and the like are used in an electrophotographic copier. Although some motors among the foregoing motors are always rotated at a constant speed, the speed of the motor for driving the optical scanning system is controlled as follows: the motor speed for a moving back operation, in which the optical system returns to a reference position after an exposure scanning operation, is higher than that for a moving forward operation in which a document is scanned for exposing.

As a motor speed control method, the following is widely known: the number of rotation of the motor is detected by an encoder; pulse signals outputted from the encoder are compared with those corresponding to a target rotational speed; PID (proportional, integral, and differential) control is conducted according to the number of pulses; and the speed control is conducted when voltage-impression upon the motor is changed by the PWM (pulse width modulation) method according to the result of the foregoing comparison. Since the control is conducted according to the pulse signal in the PID control using the encoder, the control is more exactly conducted when the encoder is used which generated a larger number of pulses while a motor is rotated once. However, since processing time necessary for one PID control is approximately determined, even when pulses are generated from the encoder in a time interval which is shorter than the foregoing processing time, the PID control can not be conducted on each pulse signal.

In Japanese Patent Publication Open to Public Inspection No. 63-69476 (69476/1988), the following copier is disclosed: an encoder which generates a large number of pulses during one rotation is used so that exact speed control can be conducted even when a motor is rotated at a low speed, for example, when an enlarging copy operation is conducted; pulse signals outputted from an encoder are divided by a predetermined number of frequencies when the motor is rotated at a high speed, for example, when a reducing copy operation is conducted; and the speed control is precisely conducted when a time interval between pulses after frequency-dividing operations, is larger than the processing time of a CPU which is necessary for one speed control operation. Accordingly, the number of frequency-dividing operations of pulse signals outputted from the encoder is separately set for each magnification ratio of copy.

However, in the invention disclosed in Japanese Patent Publication Open to Public Inspection No. 63-69476 (69476/1988), since the number of frequency dividing operations of pulse signals outputted from the encoder is set for each magnification ratio of copy with respect to a predetermined rotational speed of a motor, when the rotational speed of the motor is low while the motor speed is increased or decreased, the number of frequencies of the pulse signal outputted from the encoder is small. Accordingly, the number of PID control is small, so that the speed control can not be precisely conducted, which is a problem.

Due to the foregoing, inventors of the present invention have researched a speed control circuit of a motor as follows: an encoder is used which can generate any number of pulses, enough to conduct precise speed control, while the motor is rotated once, even at a low speed while the speed of the motor is increased or decreased; pulse signals outputted from the encoder while the speed of the motor is increased or decreased are frequency-divided by a predetermined frequency dividing number; and the speed control can be more precisely conducted when an interval between pulses after frequency-dividing operations, is longer than the processing time of a CPU which is necessary for one speed control operation.

In this connection, as a method for finding the rotational speed of the motor from the pulse signal, the following method is widely known: for example, a clock pulse generator of 10 MHz is prepared; and the number of clock pulses generated during one cycle of the pulse signal outputted from the encoder is counted. When the motor speed control is conducted by using this method, interruption of processing is generated at the time of rising of the pulse signal outputted from the encoder (hereinafter, called encoder interruption processing). Then, a calculation of the PID control is conducted according to the counted number of clock pulses and a predetermined number of a target rotational speed of the motor, and PWM signals according to the result of the calculation are outputted to the motor, in this encoder processing. Further, in order to ensure that the motor speed is reached to the predetermined rotational speed after the motor has started the rotation and a predetermined time has passed, for example, interruption of processing (hereinafter, called timer interruption processing) is generated at each 20 msec; a target rotational speed of the motor, which corresponds to an elapsed time from the start of the rotation of the motor, is set in this timer interruption processing; and the target rotational speed is used in the calculation of the PID control for the encoder interruption processing.

However, when the rotational speed of the motor is low, for example, when the motor begins to start the rotation, since the number of interruption of the encoder interruption processing is small, the number of motor speed control operations is small, so that the motor speed control can not be accurately conducted, which is a problem.

In view of the foregoing, the present invention can accurately control the motor speed even when the rotational speed of the motor is low, and the frequency of the pulse signal outputted from the encoder is low.

SUMMARY OF THE INVENTION

AS described above, in an image forming apparatus having an exposure type optical scanning system according to the present invention, a speed control circuit of a motor for driving an optical scanning system of the image forming apparatus comprises: an encoder which detects the rotational speed of the motor for driving the optical system; a target speed table in which target rotational speeds of the motor are determined stepwise corresponding to the elapsed time after the start of the rotation of the motor; a table of the number of frequency-dividing operations in which the frequency-dividing numbers used to divide pulse signals outputted from the encoder are determined stepwise corresponding to the elapsed time after the start of the motor; a reading means for reading out the number of frequency-dividing operations corresponding to the elapsed time after the start of the motor from the table of the frequency-dividing numbers at a predetermined time interval, and for reading out a target speed from a target speed table corresponding to the elapsed time after the start of the motor; a frequency dividing means for dividing the pulse signals outputted from the encoder according to the frequency-dividing numbers read out by the reading means while the speed of the motor is increased or decreased; the first control means for conducting a PID control calculation using a predetermined feedback gain according to the result of frequency-dividing operations by the frequency dividing means corresponding to the same stepwise elapsed time as the foregoing elapsed time, at the time of rising of the pulse signal outputted from the encoder, and according to the target signal read out by the reading means, and for controlling the rotational speed of the motor according to the result of the calculation; and the second control means for conducting a P control calculation using a predetermined feedback gain according to the result of frequency-dividing operations by the frequency dividing means corresponding to the same stepwise elapsed time, and a target speed which is read out by the reading means when the control by the first control means is not conducted within a predetermined time interval after the reading out operation has been conducted by the reading means, and for controlling the rotational speed of the motor according to the result of the calculation.

Due to the foregoing structure, the speed control circuit of the present invention is operated as follows. When the number of frequency-dividing operations sent from the reading means to the frequency-dividing means is equal to the number of frequency-dividing operations according to the result of the frequency dividing operation by the frequency dividing means corresponding to the same stepwise elapsed time as the foregoing elapsed time, a PID control calculation is conducted, at the time of rising of the pulse signal outputted from the encoder, using a predetermined feedback gain according to the result of frequency-dividing operations by the frequency dividing means and a new target speed which is read out by the reading means. When the number of frequency-dividing operations sent to the frequency-dividing means is different from the number of frequency-dividing operations according to the result of the frequency dividing operation obtained by the frequency dividing means, the PID control calculation is conducted using a predetermined feedback gain according to the result of the frequency-dividing operation obtained by the frequency dividing means and a new target speed which has been read out by the reading means based on the number of frequency-dividing operations which is equal to the number of frequency-dividing operations according to the result of the frequency-dividing operation, and the rotational speed of the motor is controlled according to the result of the calculation.

DETAILED DESCRIPTION OF THE INVENTION

Figure 1:
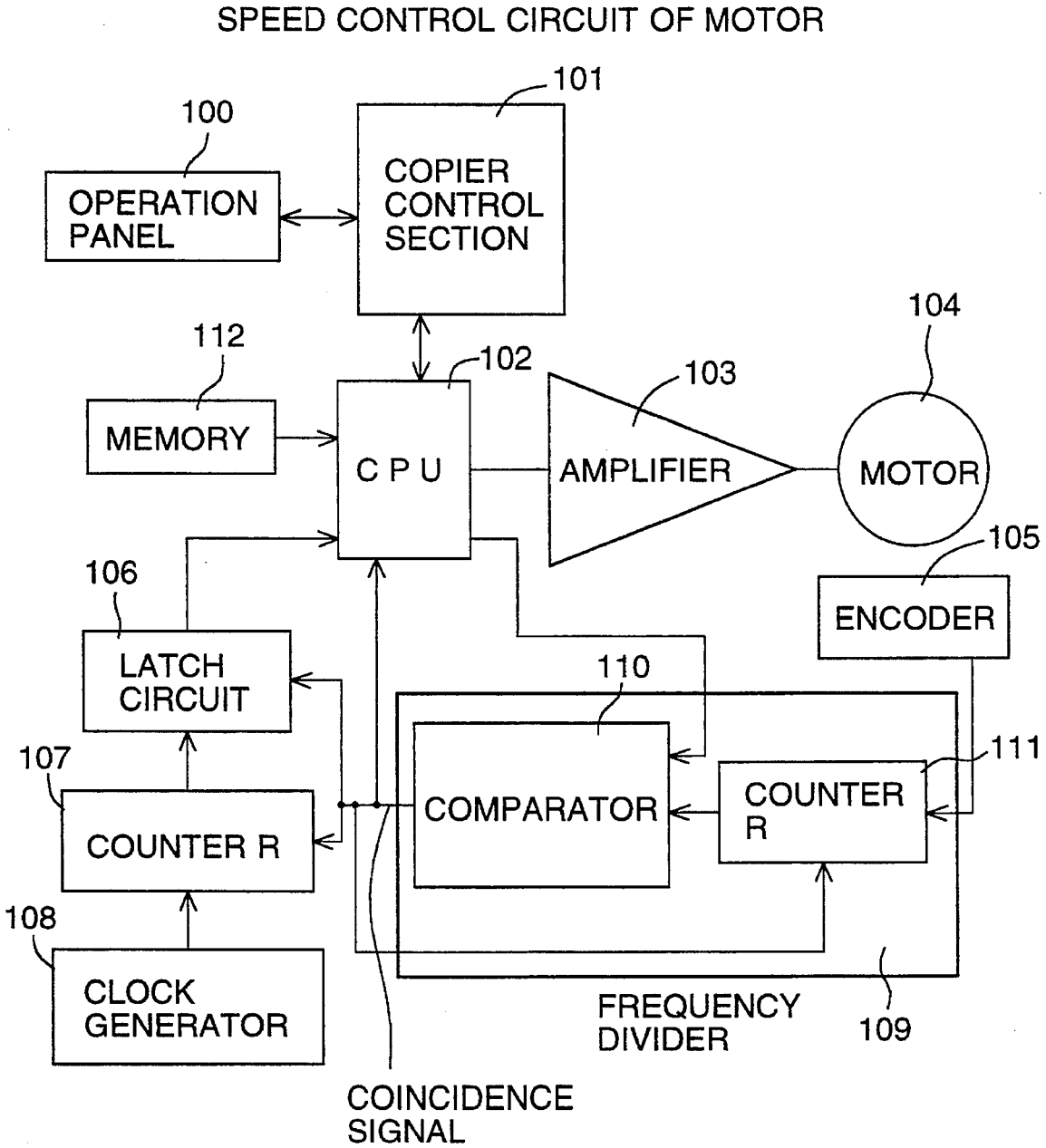
FIG. 1 is a block diagram of a speed control circuit of a motor according to the present invention.

Referring to the drawings, the present invention will be described as follows.

Figure 11:
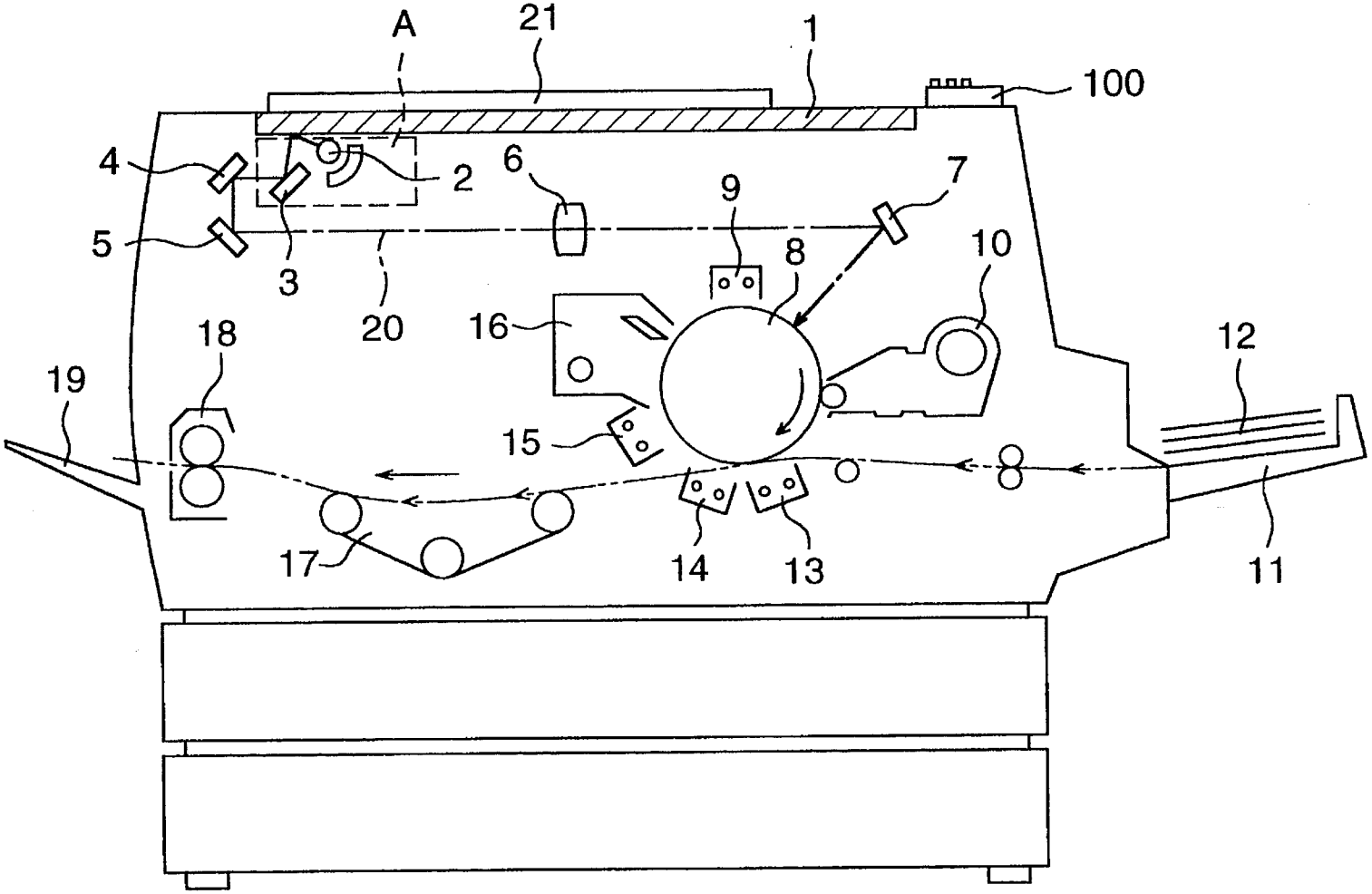
FIG. 11 is a view showing an outline structure of a copier to which the motor speed control circuit according to the present invention is applied.

FIG. 11 shows an outline structure of a copier to which a motor speed control circuit according to the present invention is applied.

Generally, a copier is operated as follows. After a power button on an operation panel 100 provided on the upper surface of the copier main body has been turned on, when a copy operation is started by a copy start key on the operation panel 100, a document 21 stacked on a platen 1 is illuminated, by an illumination lamp 2 provided in an optical scanning system A which is moved forth or back, when the optical system A is moved forth. A reflection light 20 (shown by a one-dotted chain line) from the document 21 is reflected by the first mirror 3, the second fixed mirror 4 and the third mirror 5 which are included in the optical system A. The reflected light 20 is passed through a lens 6, reflected by the fourth mirror 7, projected onto a photoreceptor drum 8, and an electrostatic latent image of the document 21 is formed on the photoreceptor drum 8. On the other hand, a copy sheet 12 is conveyed from a sheet feed cassette 11 to a transfer position through a conveyance path shown by a two-dotted chain line.

The following units are provided around the drum 8 respectively: a charging electrode 9 to uniformly charge the photoreceptor which is provided on the surface of the drum 8; developing units 10 to develop the electrostatic latent image formed on the photoreceptor into a visual image (a toner image); a transfer electrode 13 to transfer the visual image onto a copy sheet P; a separation electrode 14 to separate the copy sheet P, onto which the visual image is transferred, from the drum 8; a discharging electrode 15 to discharge charges remaining on the photoreceptor; and a cleaning unit 16 to remove toners remaining on the photoreceptor after discharging.

The electrostatic latent image formed on the photoreceptor is transferred onto the copy sheet 12 by the transfer electrode 13. The copy sheet 12, which is separated from the drum 8 by the separation electrode 14 after transfer, is conveyed to a fixing unit 18 by a conveyance roller 17 through a path shown by a two-dotted chain line. In the fixing unit 18, toners on the copy sheet 12 are thermally fused and fixed on the copy sheet 12. After that, the copy sheet 12 is delivered to the outside of the copier.

In this example, a speed control circuit of a motor according to the present invention is applied to a motor for driving the optical system shown in FIG. 11.

FIG. 1 shows a block diagram of the motor speed control circuit according to the present invention.

Numeral 100 is an operation panel of the copier shown in FIG. 11. When a copy start key provided on the operation panel 100 is pressed, a direction to start a copy operation is given to a copier control section 101. The copier control section 101 outputs a start signal to a CPU 102 at a predetermined timing, when the optical system A shown in FIG. 11 is driven while a copy processing operation is conducted.

Figure 9:
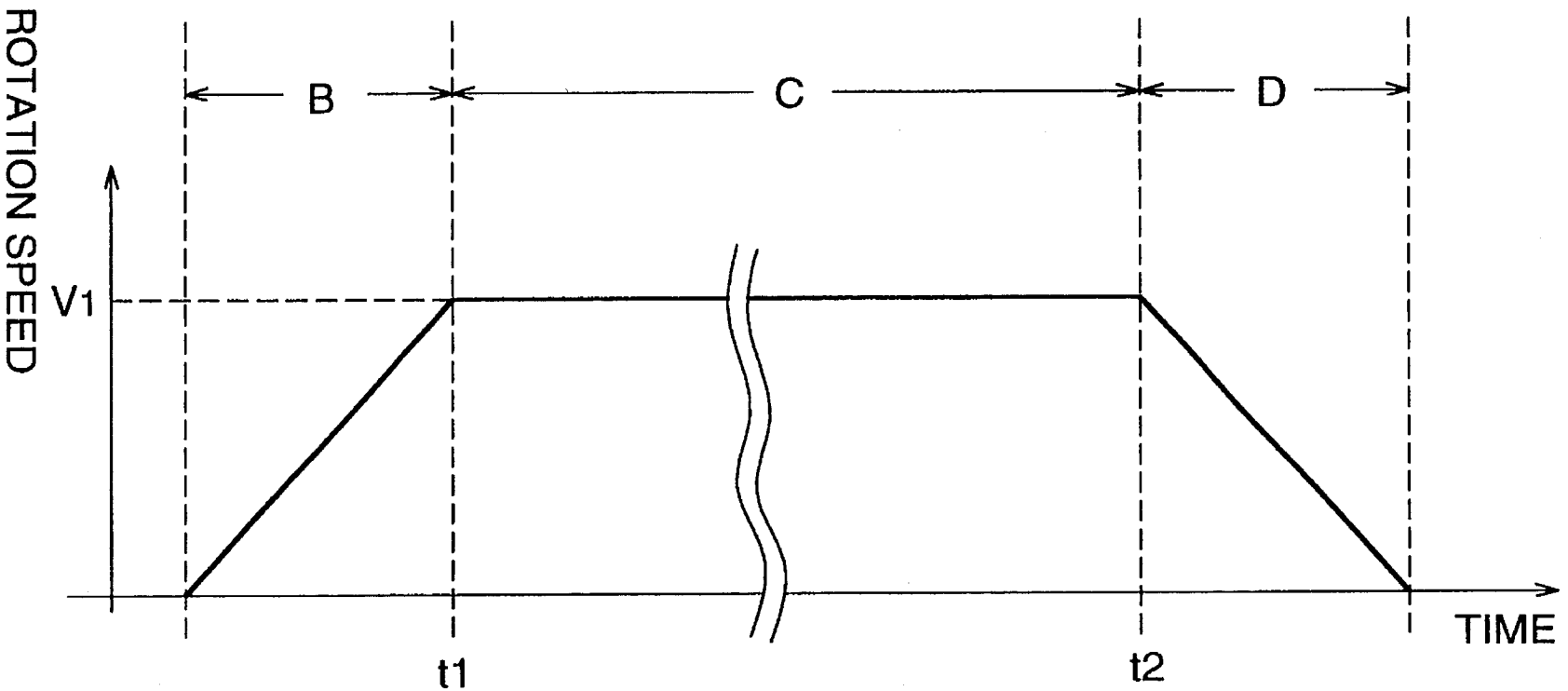
FIG. 9 is a view showing the change of the rotational speed of a motor 104 when an optical system moves forth while 1 copy operation is conducted.

Numeral 103 is an amplifier which amplifies a PWM (pulse width modulation) signal outputted from the CPU 102 to a predetermined level. When the amplified PWM signal is outputted to a motor 104, the motor 104 for driving the optical system A shown in FIG. 9 is rotated. The rotational speed of the motor 104 is controlled when a pulse width of the PWM signal is changed. The following program and tables are stored in a memory 112: a program for the speed control; a target speed table in which target speeds corresponding to an elapsed time after the motor 104 has started the rotation, are stored; a frequency-dividing number table in which the number of frequency dividing operations is stored in order to frequency-divide pulse signals outputted from an encoder 105 corresponding to the target speed; and a PID gain table in which gains for the PID control corresponding to the number of frequency dividing are stored. The program stored in the memory 112 is executed by the CPU 102.

Numeral 105 is an encoder which optically detects the rotation of the motor 104, and outputs pulse signals corresponding to the rotation speed. A counter 111 counts the number of pulses of the pulse signals outputted from the encoder 105, and the counted number is outputted to a comparator 110. The comparator 110 compares the counted number inputted from the counter 111 with the number of frequency-dividing inputted from the CPU 102, and when they are coincident with each other, a coincidence signal is outputted. The coincidence signal outputted from the comparator 110 clears the counted number of the counter 111 and the counter 107 to zero, and simultaneously directs a latch circuit 106 to hold the counted number sent from the counter 107. The coincidence signal is inputted into the CPU 102. A frequency divider 109 comprises the comparator 110 and the counter 111.

Numeral 108 is a clock pulse generator, and generates clock pulses having a frequency of 10 MHz. The counter 107 counts the number of clock pulses generated from the clock generator 108, and outputs the counted number to the latch circuit 106. The latch circuit 106 holds the counted number at the time when the latch circuit 106 receives the coincidence signal outputted from the comparator 110, and outputs the counted number to the CPU 102.

In this example, the counter 107 counts the number of clock pulses generated from the clock pulse generator 108 within the elapsed time from the time when the coincidence signal is outputted from the comparator 110, to the time when the next coincidence signal is outputted, and the counted number is used as the actual rotation speed of the motor 104.

Figure 7:
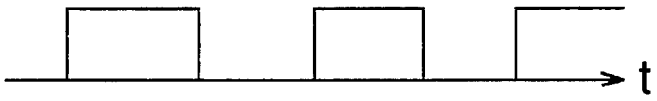
FIG. 7(*a*) to FIG. 7(*d*) are views showing the relationships among a pulse signal outputted from an encoder 105, a coincidence signal outputted from a comparator 110, a clock pulse outputted from a clock generator 108, and the number of counted clock pulses, in the case where the number of frequency-dividing operation is 1 (1 frequency dividing).
Figure 7:
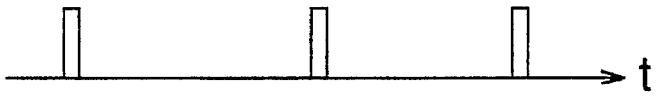
Figure 7:
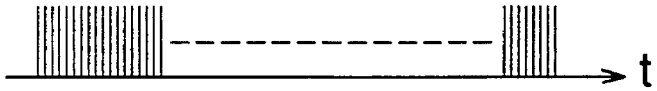
Figure 7:
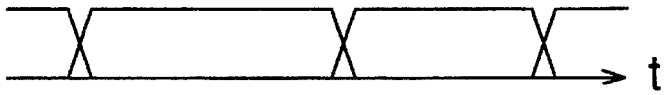
Figure 8:
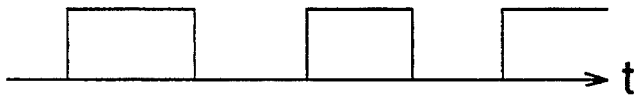
FIG. 8(*a*) to FIG. 8(*d*) are views showing the relationships among a pulse signal outputted from an encoder 105, a coincidence signal outputted from a comparator 110, a clock pulse outputted from a clock generator 108, and the number of counted clock pulses, in the case where the number of frequency-dividing operations is 2 (2 frequency dividing).
Figure 8:
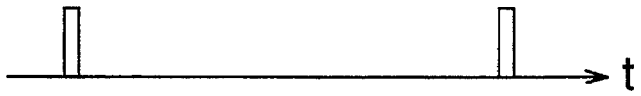
Figure 8:
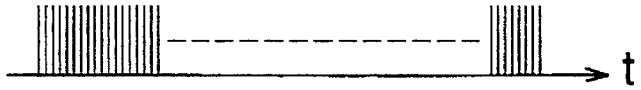
Figure 8:
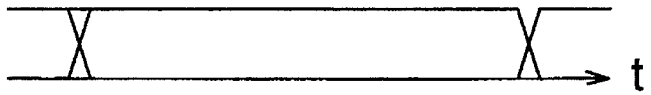

Here, (a) the number of pulse signals outputted from the encoder 105, (b) a coincidence signal outputted from the comparator 110, (c) clock pulses generated from the clock pulse generator 108, and (d) the number of counted clock pulses sent from the latch circuit 106 are shown in FIG. 7 and FIG. 8, using a horizontal axis as a time axis. In the foregoing, FIG. 7 shows the case where the number of frequency-dividing operations is 1 (1 frequency-dividing), and FIG. 8 shows the case where the number of frequency-dividing operations is 2 (2 frequency-dividing).

Next, using flow charts shown in FIGS. 2, 3, 4, 5 and 6, speed control processing by the CPU 102 will be described as follows.

Figure 2:
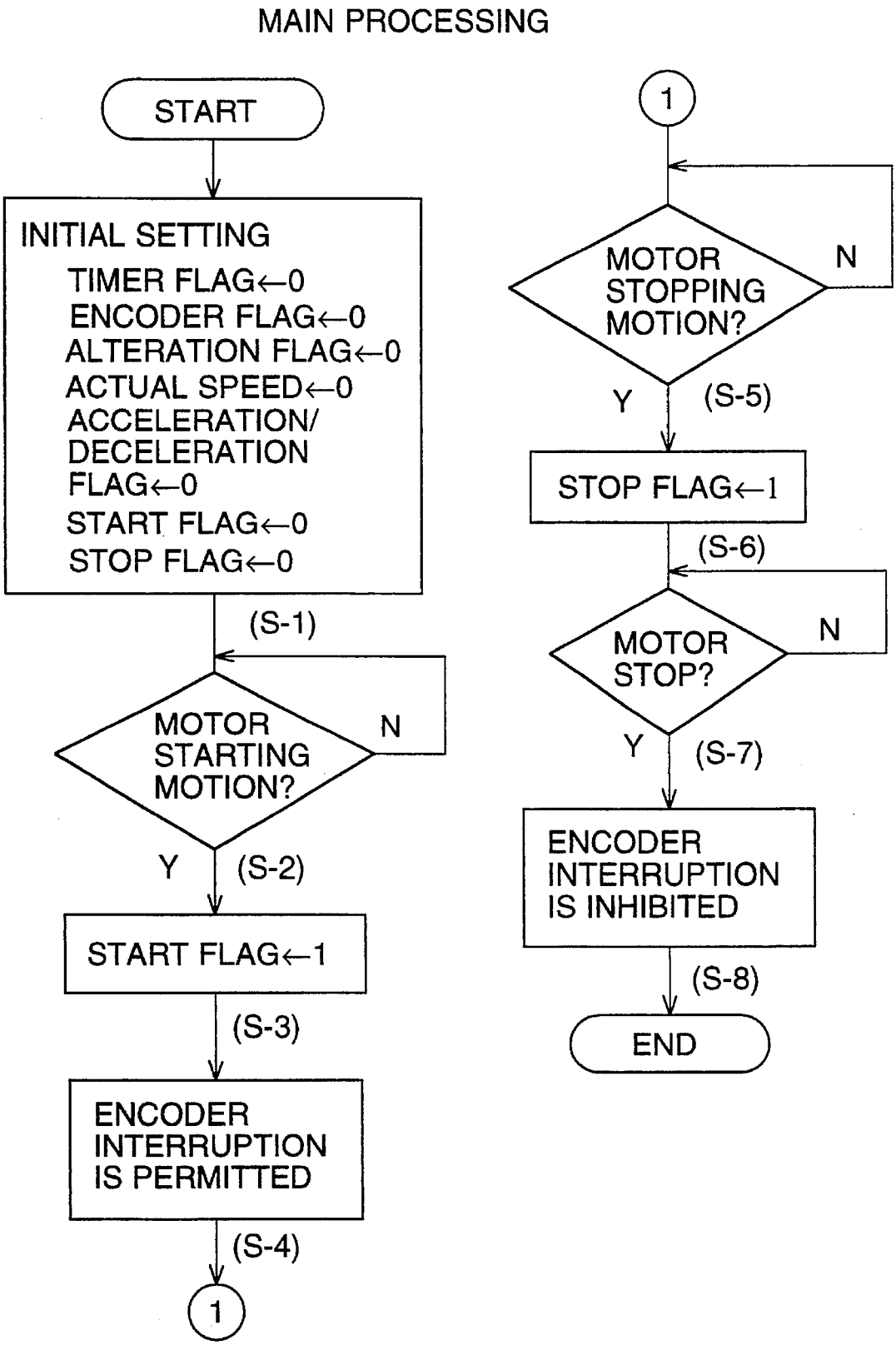
FIG. 2 is a flow chart showing a main processing operation of the present invention.
Figure 3:
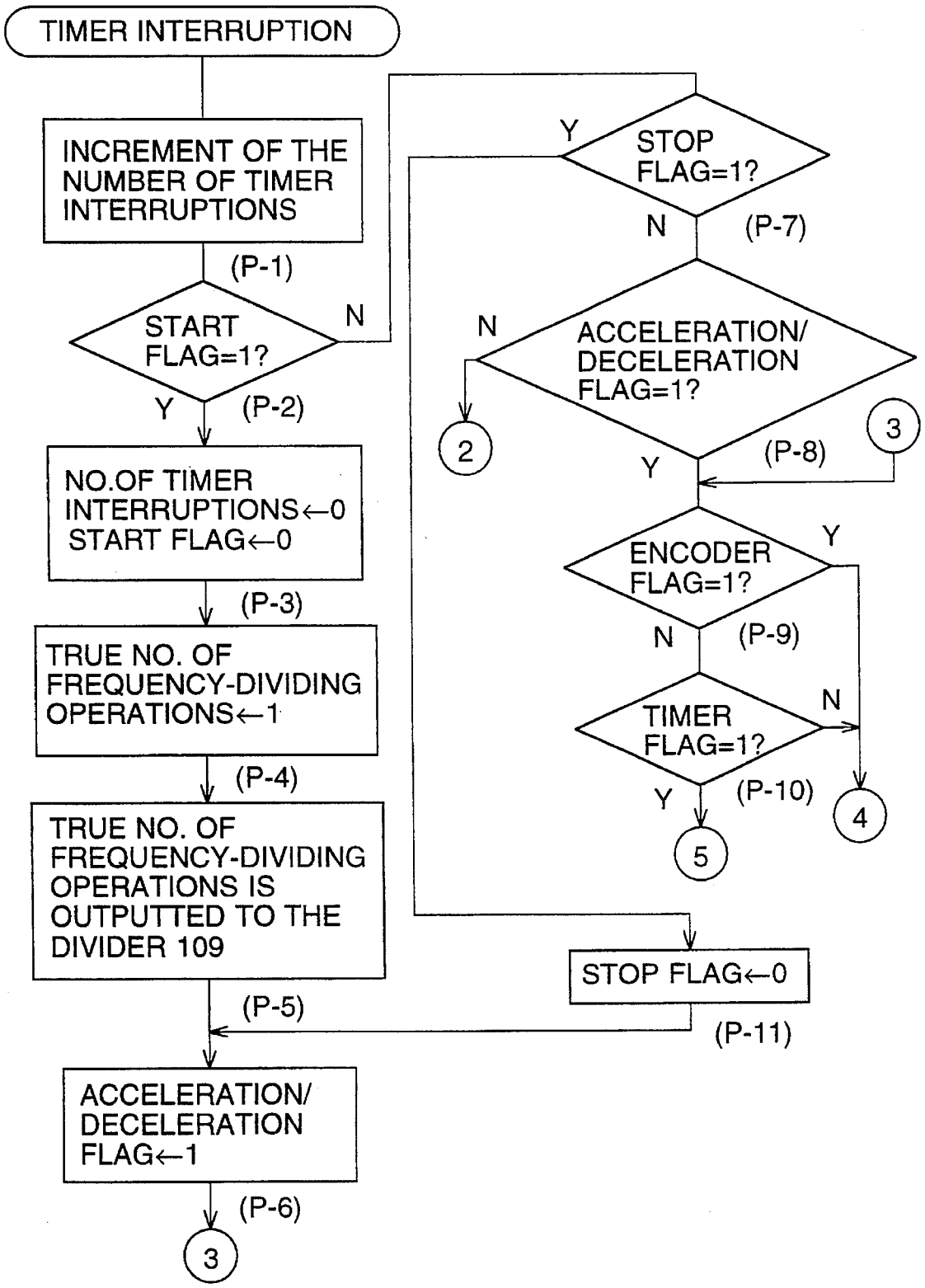
FIG. 3 is a portion of a flow chart showing a timer interruption processing operation according to the present invention.
Figure 4:
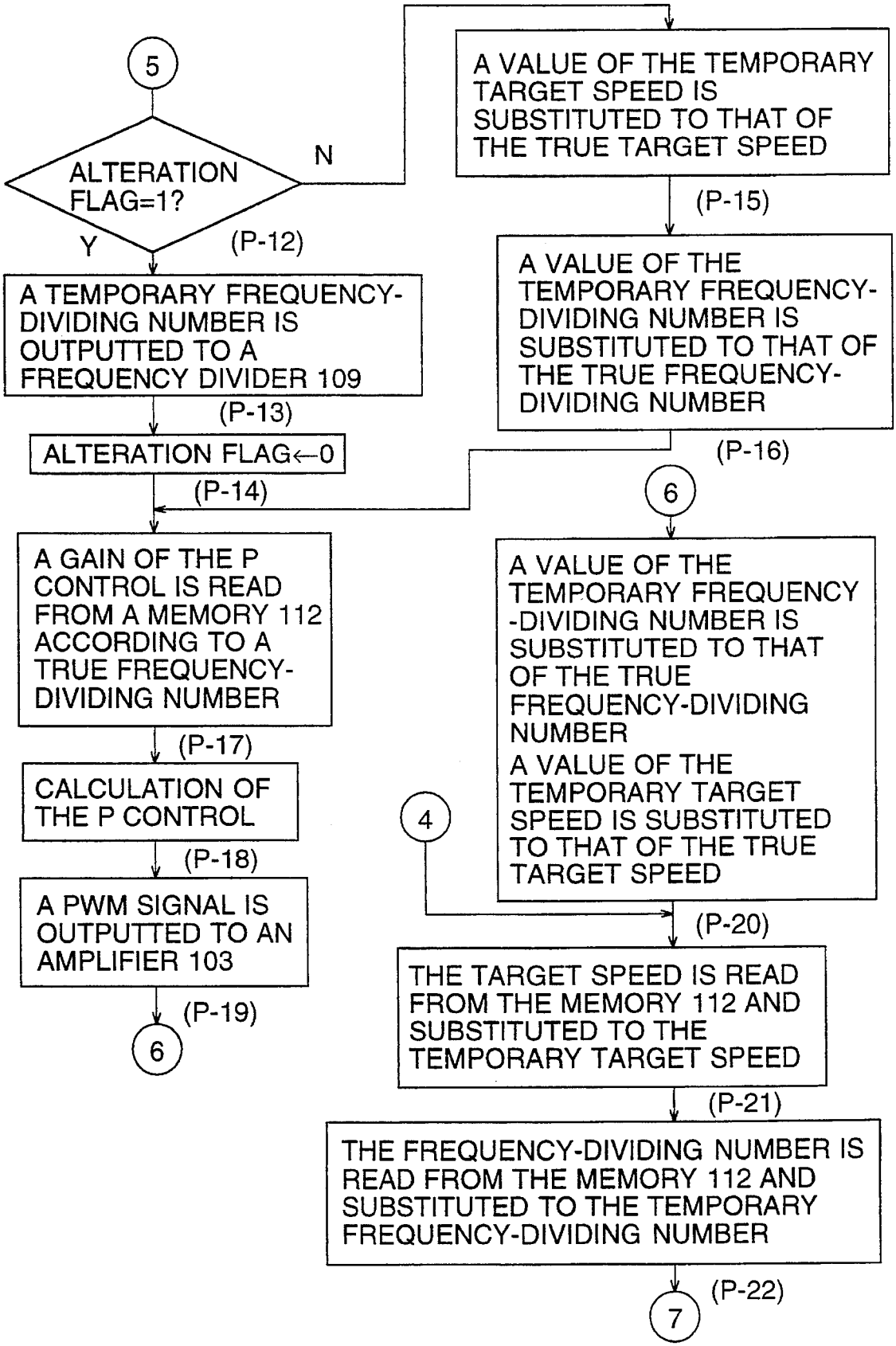
FIG. 4 is a continuation of the flow chart of the timer interruption processing operation shown in FIG. 3.
Figure 5:
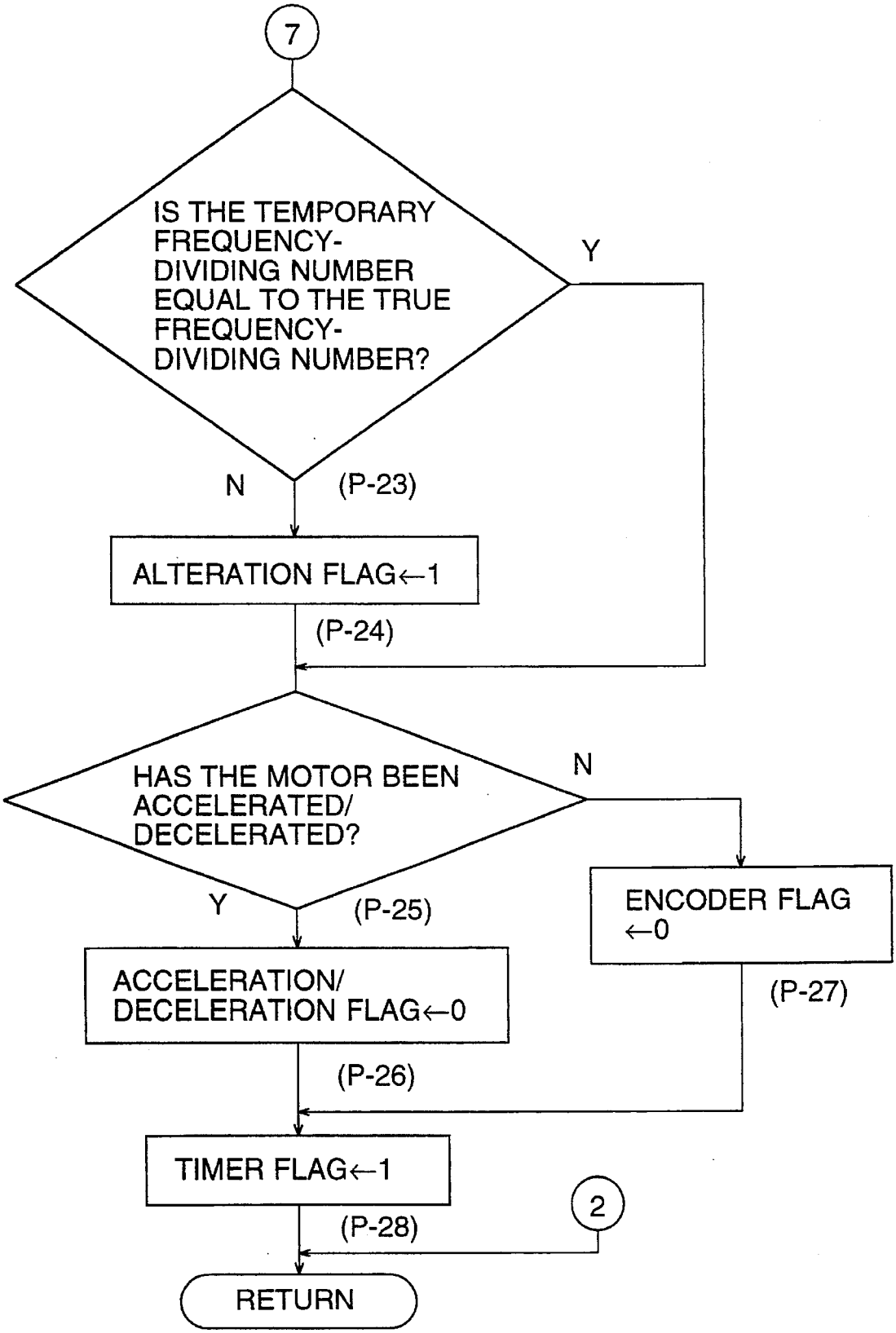
FIG. 5 is a continuation of the flow chart of the timer interruption processing operation shown in FIG. 4.
Figure 6:
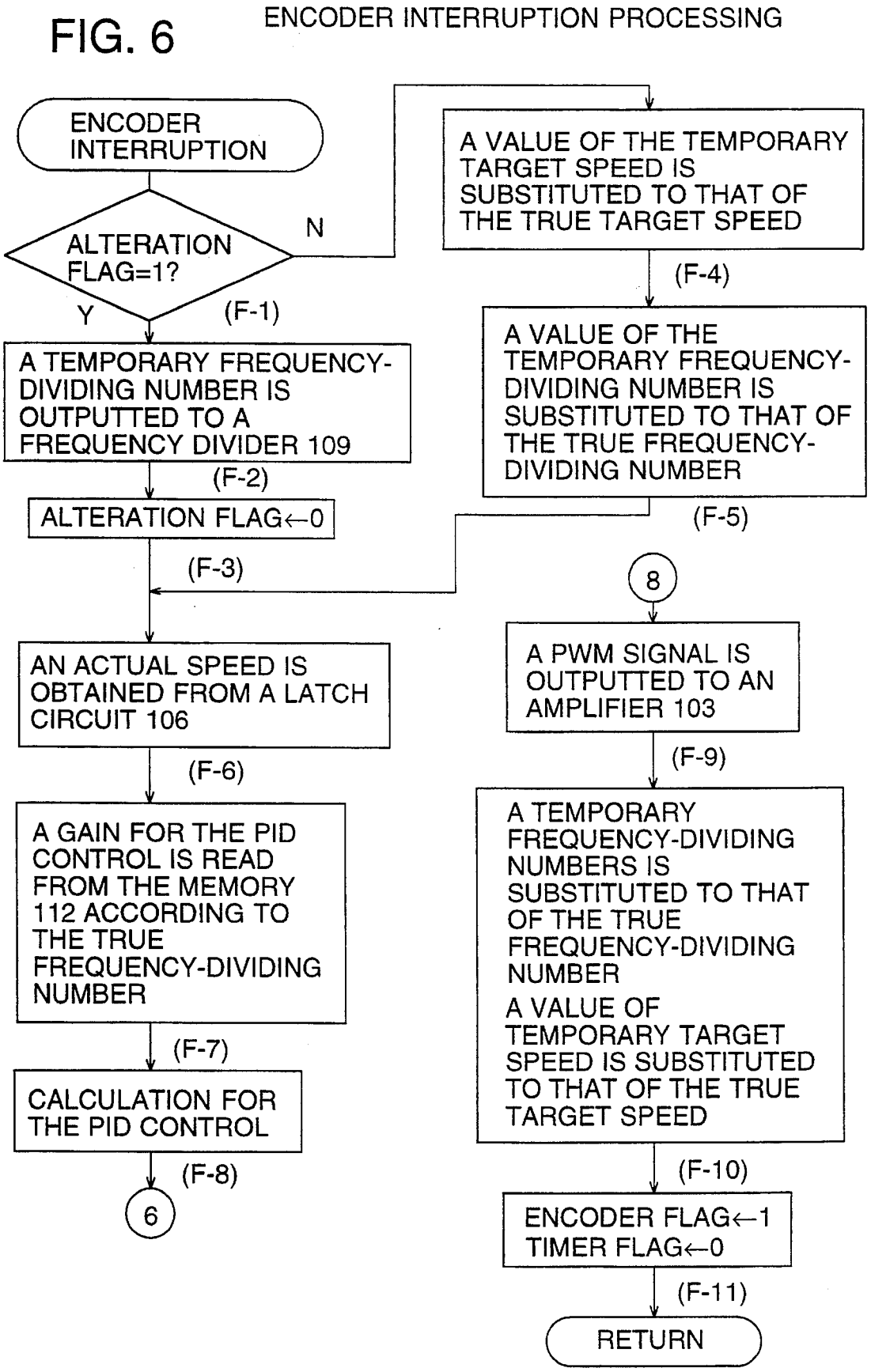
FIG. 6 is a flow chart showing an encoder interruption processing operation according to the present invention.

Speed control processing by the CPU 102 includes a main processing shown in FIG. 2, a timer interruption processing shown in FIGS. 3, 4 and 5, and an encoder interruption processing shown in FIG. 6. While main processing is executed, main processing is normally interrupted by timer interruption processing at 20 mS interval, and is interrupted by encoder interruption processing at every time when the coincidence signal is received. Timer interruption processing and encoder interruption processing are exclusive to each other, and while one interruption processing is executed, the other interruption processing can not interrupt main processing.

Here, outline of the speed control according to the present invention will be described as follows.

FIG. 9 shows changes of the rotation speed of the motor 104 for driving the optical scanning system when the optical system moves forth in one copy operation.

The motor 104 is accelerated within a section B after its start, the speed of the motor reaches a predetermined speed v1, and is kept constant in a section C. The document is exposed by the optical scanning system A in the section C. After that, the motor 104 is decelerated in the section D. In the speed control according to the present invention, as an example, 20 timer interruption processing are executed in the section B, 300 timer interruption processing are executed in the section C, and 20 timer interruption processing are executed in the section D.

In this example, the speed control of the motor 104 is conducted by the PID control. The elapsed time after the motor 104 has been started its rotation is divided into constant time intervals. The target speeds corresponding to time intervals (the target count number of clock pulses to be outputted from the clock generator 108 within the period of time from the time, when the coincidence signal is outputted from the comparator 110, to the time when the next coincidence signal is outputted) are prepared respectively. The number of frequency-dividing operations, by which pulse signals outputted from the encoder 105 corresponding to the foregoing time intervals are frequency-divided, is prepared respectively. Different gains of the PID control corresponding to the number of frequency-dividing operations are prepared respectively. The foregoing target speed, the number of frequency-dividing operations, and PID gains are respectively stored in a memory 112 as a target speed table, a frequency-dividing number table, and a PID gain table, and these tables are successively read out as the motor 104 is rotated. The table 1, table 2, and table 3, which will be shown later, show one example of values stored in these tables.

Figure 10:
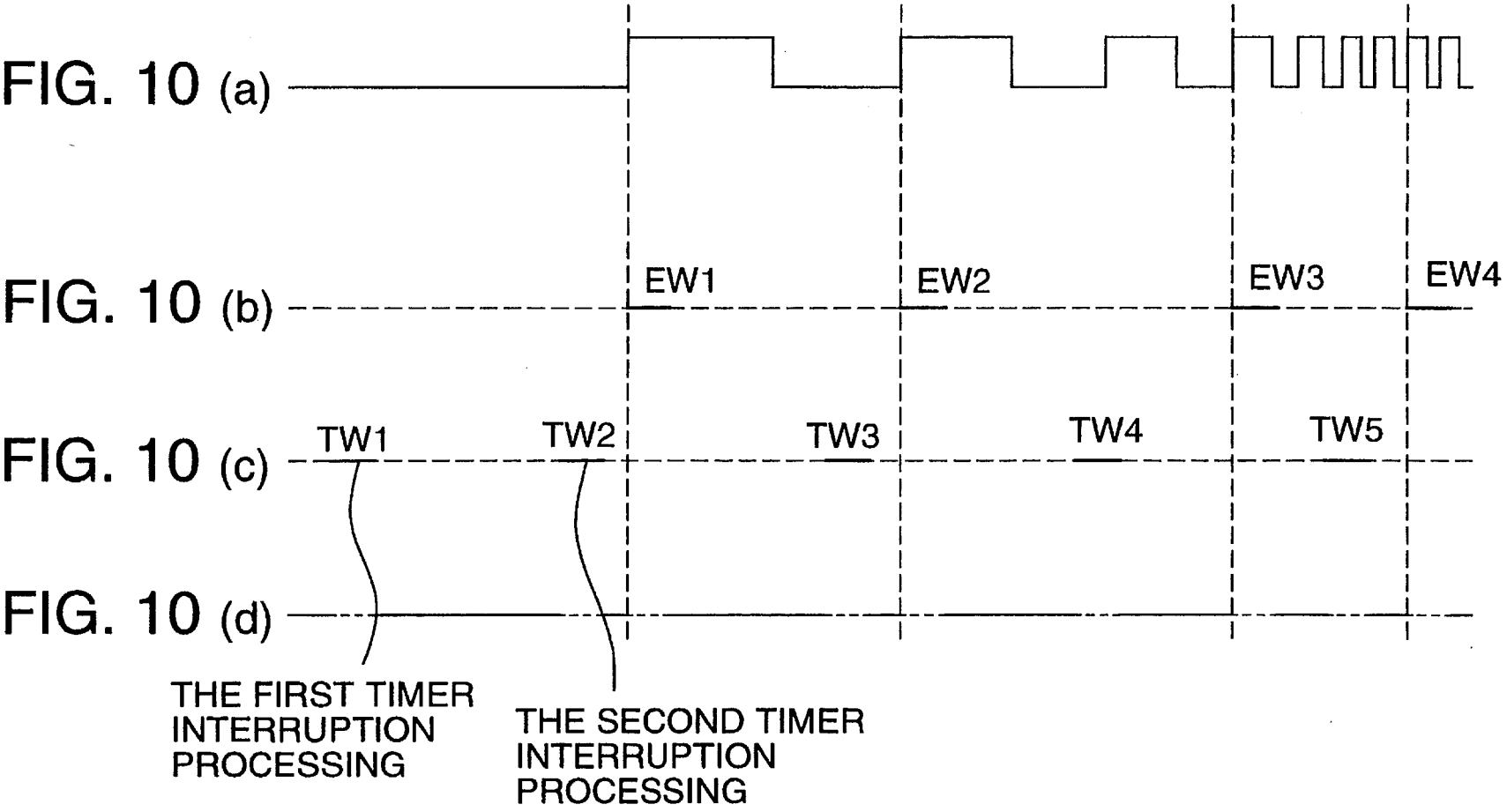
FIG. 10(*a*) to FIG. 10(*d*) are views showing the relationships among a pulse signal outputted from the encoder 105, a timing when the encoder interruption processing operation is conducted, a timing when the timer interruption processing operation is conducted, and a timing when the main processing operation is conducted.

In FIG. 10, the relation among (a) pulse signals outputted from the encoder 105, (b) the time to carry out encoder interruption processing, (c) the time to carry out timer interruption processing, and (d) the time to carry out main processing, is shown.

FIG. 10(*b*), FIG. 10(*c*), and FIG. 10(*d*) show that the foregoing processing operations are respectively carried out in real line portions. In this example, the target speed and the number of frequency-dividing operations are read out from the target speed table and the frequency-dividing number table stored in the memory 112 according to the number of timer interruptions which show how many times the timer interruption is carried out, in timer interruption processing shown in FIG. 10(*c*). In timer interruption processing in FIG. 10(*c*), the number of frequency-dividing operations is changed with respect to a divider 109. Simultaneously, the PID gain is read out according to the number of frequency-dividing operations at that time, PID control calculation is conducted, and the PWM signal is outputted to the amplifier 103.

In Table 1 and Table 2, values of the target speed and the number of frequency-dividing operations corresponding to timer interruption processing are stored. Values of the PID control gain corresponding to the number of frequency-dividing operations are stored in Table 3. For example, in the timer interruption processing TW2 which is carried out at the time of the second timer interruption shown in FIG. 10, the target speed of 400 pulses and the number of frequency-dividing operations of one are respectively read from the target speed table and the frequency-dividing number table. From the result of the foregoing timer interruption processing TW2, in encoder interruption processing EW1 in which the number of frequency-dividing operations is one, the P gain, I gain and D gain are respectively read from the PID gain table, in which P gain is 2, I gain is 2, and D gain is 2.

TABLE 1

| No. of timer interruptions | 0 | 1 (TW1) | 2 (TW2) | 3 (TW3) | 4 (TW4) |
|---|---|---|---|---|---|
| Target speed (pulses) | 500 | 500 | 400 | 500 | 300 |

TABLE 2

| No. of timer interruptions | 0 | 1 (TW1) | 2 (TW2) | 3 (TW3) | 4 (TW4) |
|---|---|---|---|---|---|
| No. of frequency-dividing operations | 1 | 1 | 1 | 2 | 4 |

TABLE 3

| No. of frequency-dividing operations | 1 | 2 | 3 | 4 |
|---|---|---|---|---|
| P gain | 2 | 4 | 6 | 8 |
| I gain | 2 | 4 | 6 | 8 |
| D gain | 2 | 4 | 6 | 8 |

Due to the foregoing, as the rotation speed of the motor 104 is increased, each necessary value is read from each corresponding table, and the speed control is successively carried out.

The content of speed control processing according to the present invention will be described with respect to each processing as follows.

(1) Main processing

At first, referring to FIG. 2, main processing will be described as follows.

When the CPU 102 receives the start signal from a copier control section 101 shown in FIG. 1, main processing is started, and at first, initial setting is carried out (S-1). Next, the CPU 102 waits for the direction of the motor start sent from the copier control section 101 after a predetermined time has passed (S-2). When the direction of the motor start operation is inputted to the CPU 102, a start flag is set to 1 (S-3), the interruption of encoder interruption processing is permitted (S-4), and the motor is accelerated.

After that, the motor speed is controlled by timer interruption processing and encoder interruption processing which will be described later. The motor speed is gradually increased and reaches a predetermined speed $v_1$, and then, exposure scanning is carried out. After a predetermined period of time according to sizes of documents has passed, the copier control section 101 outputs the direction of the motor stop. In main processing, the CPU waits for the direction of the motor stop (S-5), and when the the direction is received by the CPU, a stop flag is set to 1 (S-6), and the motor 104 is controlled to decelerate its speed.

It can be found from the output of the encoder 105 that the motor 104 is stopped (S-7). When the motor 104 is stopped, encoder interruption processing is inhibited (S-8), and the main processing is completed.

(2) Timer interruption processing

Next, referring to FIG. 3, FIG. 4, and FIG. 5, timer interruption processing will be described.

When main processing shown in FIG. 2 is carried out, the timer interruption processing is conducted at every 20 msec interval.

Before the start flag is set to 1 in step (S-3), the number of the timer interruptions is increased at every timer interruption in step (P-1). The sequence advances to (No) in step (P-2), advances to (No) in step (P-7), further advances to (No) in step (P-8), and the timer interruption processing is completed. The number of timer interruptions before the start flag is set to 1, is not referred at any step. The number of timer interruptions which is increased in step (P-1) has meanings after the start flag is set to 1 (P-2) and the number of timer interruptions is cleared to zero, and is counted.

After the start flag has been set to 1 in step (S-3) in FIG. 2 (in TW1-processing in FIG. 10), the number of timer interruptions is increased in step (P-1). After that, the sequence advances to (Yes) in step (P-2), the number of timer interruptions is cleared to zero, and the start flag is set to 0 (P-3). After that, a value of the variable, which is called the true frequency-dividing number, is set to 1 (p-4), and the value of the true frequency-dividing number is outputted to the comparator 110 in the frequency divider 109 shown in FIG. 1 (P-5), and pulse signals outputted from the encoder 105 are processed without any frequency-dividing operation. Next, an acceleration/deceleration flag is set to 1 (P-6), and thereby, it is expressed that the motor is accelerated or decelerated now.

In the next step (P-9), an encoder flag showing whether encoder interruption processing has been carried out or not just before this timer interruption processing is carried out, is checked. In this timer interruption processing, since the processing is carried out just after the start flag has been set to 1 in main processing, encoder interruption processing is not carried out yet, and the encoder flag is 0. Therefore, the sequence advances to step (P-10).

In step (P-10), a timer flag showing whether timer interruption processing has been carried out or not just before this timer interruption processing is carried out, is checked. Since this timer interruption processing is carried out just after the start flag has been set to 1 in main processing, no timer interruption processing has been carried out before, and the timer flag is 0. Therefore, the program advances to step (P-21) shown in FIG. 4.

In step (P-21), the CPU 102 reads the target rotation speed of the motor (here, 500 pulses) corresponding to 0 time timer interruption from the memory 112, and substitutes it to a variable (which is named a temporary target speed). In the next step (P-22), the CPU reads the number of frequency-dividing operations (here, 1 frequency-dividing) corresponding to 0 time timer interruption from the memory 112, and substitutes it to a variable (which is named a temporary frequency-dividing number).

The program advances to step (P-23) shown in FIG. 5, and checks whether the temporary frequency-dividing number is equal to the true frequency-dividing number. In this time, since both the temporary frequency-dividing number and the true frequency-dividing number are 1 as described above, the program advances to step (P-25), and checks whether the acceleration/deceleration of the motor 104 has been completed or not. It is checked by the following method whether the acceleration/deceleration of the motor has been completed or not: in step (P-3) in FIG. 3, it is judged from how many times timer interruption processing have been conducted from the time when the number of timer interruptions has been cleared to zero. For example, in the case where 20 times timer interruption processing have been conducted (processing in the section B shown in FIG. 9 has been completed), it is considered that the acceleration of the motor has been completed. In this time, since the number of timer interruption processing is 0 (in step (P-3), the number is cleared to zero), the program advances to (No), and the encoder flag is set to 0 (P-27). Simultaneously, the timer flag is set to 1 (P-22), and this processing is completed.

Next, since the PWM signal is not outputted to the motor 104 yet, the program is interrupted again by timer interruption processing after time of 20 msec has passed (processing in TW2 in FIG. 10). At first, after the number of timer interruption has been increased in step (P-1) shown in FIG. 3, the start flag is checked (P-2). At this time, since the start flag is 0 (it is set to 0 in step (P-3) in TW1 in FIG. 10), the program advances to step (P-7). In step (P-7), the stop flag is checked. At this time, since the stop flag is 0 (it has been set to 0 in step (S-1) in main processing), the program advances to step (P-8).

In step (P-8), since the acceleration/deceleration flag is 1 in this timer interruption processing (it has been set to 1 in step (P-6) in TW1 in FIG. 10), the program advances to step (P-9). In step (P-9), the encoder flag showing whether encoder interruption processing has been conducted or not just before this timer interruption processing is conducted, is checked. Since this timer interruption processing is conducted before the motor 104 is given the direction of rotation (the output of the PWM signal), encoder interruption processing has not been conducted yet. Accordingly, the encoder flag is 0, and the program advances to step (P-10).

In step (P-10), the timer flag showing whether timer interruption processing has been conducted or not just before this timer interruption processing is conducted, is checked. In this timer interruption processing, since the timer flag is set to 1 in preceding timer interruption processing, the program advances to step (P-12) shown in FIG. 4.

In step (P-12), an alteration flag showing whether the number of frequency-dividing operations has been changed or not, is checked. In this time, the number of frequency-dividing operations is not changed, and the alteration flag is 0 (it has been set to 0 in step (S-1) in main processing). Accordingly, the program advances to step (P-15), a value of the temporary target speed (500 pulses), which has been read from the memory 112 in the preceding timer interruption processing, is substituted to a variable (which is named a true target speed). Then, the value of the temporary frequency-dividing number (1 frequency-dividing) is substituted to a variable, which is named a true frequency-dividing number, (P-16).

Then, a gain for the P control (proportional control) (here, the gain is 2) is read (P-17) from the memory 112 according to the value of the true frequency-dividing number (1 frequency-dividing). A calculation for the P control is conducted using the gain and the value of the true target speed (P-18). The result of the calculation is outputted as the PWM signal to the amplifier 103 shown in FIG. 1 (P-19). In this example, as a general rule, the calculation of the PID control is conducted and the PWM signal is outputted in encoder interruption processing. However, as an exception, when encoder interruption processing is not conducted after timer interruption processing has been completed, and 2 timer interruption processing are successively conducted, the calculation of only P control in the PID control is conducted and the PWM signal is outputted, in the second timer interruption processing. When the rotation speed of the motor is very low, encoder interruption processing is not conducted after timer interruption processing has been completed, and 2 timer interruption processing are successively conducted. Accordingly, processing is simplified in order to increase the speed of the motor as soon as possible, and therefore, to conduct only P control. Then, the PWM signal is outputted by timer interruption processing.

After that, the value of the temporary frequency-dividing number is substituted to the true frequency-dividing number, and the value of the temporary target speed is substituted to the true target speed (P-20). Then, after processing has been conducted in the same way as the preceding timer interruption processing, timer interruption processing in TW2 is completed (P-21, P-22, P-23, P-25, P-27, P-28).

In this connection, in the case where the program advances to step (p-23) shown in FIG. 5, when the temporary frequency-dividing number is not equal to the true frequency-dividing number, the alteration flag is set to 1 in order to notice that the number of frequency-dividing operations has been changed (P-24), and the program advances to step (P-25).

In step (P-25), the program checks whether the acceleration of the motor 104 has been completed or not. When the number of timer interruption is 20, it is assumed that the acceleration of the motor 104 has been completed (processing within the section B shown in FIG. 9 has been completed). Then, the acceleration/deceleration flag is set to 0 (P-26), the timer flag is set to 1 (P-28), and timer interruption processing is completed.

In the section C shown in FIG. 9, only timer interruption processing in steps (P-1, P-2, P-7,and P-8) is conducted.

Further, in the section D shown in FIG. 9, in the same way as processing at the time of acceleration of the motor, the target speed, the number of frequency-dividing operations, and the PID gain are read from the memory 112 according to the number of timer interruptions, and deceleration processing of the motor is conducted.

In step (P-19) in timer interruption processing in TW2 shown in FIG. 10, when the PWM signal is outputted, the motor 104 is started, and the coincidence signal as shown in FIG. 7(*b*) is outputted from the comparator 110. Encoder interruption processing, which will be described later, interrupts the program at the time of rising of the coincidence signal.

(3) Encoder interruption processing

Encoder interruption processing will be described as follows referring to FIG. 6.

In encoder interruption processing, it is checked whether the alteration flag is 1 or not, in order to check whether the number of frequency-dividing operations read from the memory 112 in the timer interruption processing is changed or not comparing with the number of frequency-dividing operations which is used up to the present time (F-1). When the alteration flag is not set to 1, the value of the temporary target speed, which has been read from the memory 112 in the timer interruption processing conducted just before the present time, is substituted to the true target speed (F-4), and the value of the temporary frequency-dividing number read from the memory 112 in timer interruption processing conducted just before the present time, is substituted to the true frequency-dividing number (F-5).

When the alteration flag is set to 1, the value of the temporary frequency-dividing number read from the memory 112 in timer interruption processing conducted just before the present time, is outputted to the comparator 110 in the divider 109 shown in FIG. 1 (F-2), and the alteration flag is set to 0 (F-3).

Successively, in step (F-6), the actual rotation speed of the motor 104, which is held in the latch circuit 106 shown in FIG. 1, is obtained. Then, the gain for PID (proportional, integral, differential) control is read from the memory 112 according to the value of the true frequency-dividing number (F-7). The calculation of the PID control is conducted using this gain, the value of the true target speed, and the actual rotation speed obtained in step (F-6), (F-8). The result of the calculation is outputted to the amplifier 103 shown in FIG. 1 as the PWM signal (F-9).

After that, the temporary frequency-dividing number is substituted to the true frequency-dividing number, and simultaneously, the value of the temporary target speed is substituted to the true target speed (F-10). Then, the encoder flag is set to 1, the timer flag is set to 0 (F-11), and encoder interruption processing is completed.

Encoder interruption processing is conducted similarly in the section B (on acceleration), section C (on a constant speed), and section D (on deceleration). The calculation of the PID control is conducted and the PWM signal is outputted according to the alteration flag, the temporary target speed, and the temporary frequency-dividing number which are set in timer interruption processing.

As described above, in this example, even when the motor 104 is accelerated or decelerated, pulse signals outputted from the encoder 105 are frequency-divided by the number of frequency-dividing operations previously stored in the memory 112 (P-22, F-2). When the number of frequency-dividing operations is changed, the PID gain, which is appropriate for the new frequency-dividing number, is read from the memory 112, and thereby, the more accurate PID control calculation can be conducted (F-7, F-8). Further, the temporary target speed and the true target speed are set, and the target speed before the number of frequency-dividing operations is changed and the new target speed after the number of frequency-dividing operations has been changed can be stored. Therefore, the calculation of the PID control can be conducted using the target speed according to the same number of frequency-dividing operations as that in the case where the actual rotation speed has been obtained from the latch circuit 106 (F-1, F-2, F-3, F-4, F-5, F-6, F-8). Further, when the program is interrupted again by new timer interruption processing after timer interruption processing has been conducted and before encoder interruption processing is conducted, the calculation of P control is conducted and the PWM signal is outputted at the time of interruption of the second timer interruption processing. Accordingly, even when the motor is rotated at a low speed, the speed of the motor can be accurately controlled (P-9, P-10, P-18, P-19).

What is claimed is:

1. A speed controlling apparatus for controlling an optical scanning system driving motor in use with an image forming apparatus, comprising;

an encoder which generates pulse signals according to a rotation of said optical scanning system driving motor;

a generator for generating reference signals;

a first memory for storing a first set of a plurality of numbers for dividing a frequency of said pulse signals generated by said encoder;

a second memory for storing a second set of a plurality of numbers corresponding to a target rotation speed of said optical scanning system driving motor;

a first setting unit for reading one of said first set of numbers from said first memory and for setting said one of said first set of numbers at every predetermined interval time while said optical scanning system driving motor is accelerating or decelerating;

a second setting unit for reading one of said second set of numbers from said second memory and for setting said one of said second set of numbers at every predetermined interval time while said optical scanning system driving motor is accelerating or decelerating;

a divider for dividing said frequency of said pulse signals according to said one of said first set of numbers;

a detector for detecting a rotating speed of said optical scanning system driving motor according to said reference signals and pulse signals at every frequency period which is divided by said divider;

a comparing unit for comparing said rotating speed, detected by said detector, with said one of said second set of numbers, set by said second setting unit, at every frequency period which is divided by said divider, and for outputting a comparison result; and a feedback path including the encoder and the comparing unit for feeding back signals from the encoder to a controller for controlling said rotating speed of said optical scanning system driving motor according to said comparison result of said comparing unit.

2. The apparatus of claim 1, wherein:

said first memory stores said first set of numbers stepwisely corresponding to an elapsed time after a start of rotation of said optical scanning system driving motor;

and said first setting unit reads said one of said first set of numbers according to an elapsed time after a start of rotation of said optical scanning system driving motor.

3. The apparatus of claim 2, wherein:

said second memory stores said second set of numbers stepwisely corresponding to an elapsed time after a start of rotation of said optical scanning system driving motor; and said second setting unit reads said one of said second set of numbers according to an elapsed time after a start of rotation of said optical scanning system driving motor.

4. The apparatus of claim 3, further comprising:

a third memory for storing a plurality of gain data for PID control; and a third setting unit for reading one of said gain data from said third memory and for setting said one of said gain data at every predetermined interval time while said optical scanning system driving motor is accelerating or decelerating; and wherein said controller controls said rotating speed of said optical scanning system driving motor according to said comparison result of said comparing unit and said one of said gain data set by said third setting unit.

5. The apparatus of claim 4, wherein:

said third memory means stores said gain data stepwisely corresponding to an elapsed time after a start of rotation of said optical scanning system driving motor; and said third setting unit reads said one of said gain data according to an elapsed time after a start of rotation of said optical canning system driving motor.

6. The apparatus of claim 5, wherein said first setting unit, said second setting unit, and said third setting means respectively set said one of said first set of numbers, said one of said second set of numbers, and said one of said gain data at a same predetermined elapsed time.

7. The apparatus of claim 6, wherein said controller controls said rotating speed of said optical scanning system driving motor in synchronism with a frequency period which is divided by said divider, after said first setting unit, said second setting unit, and said third setting unit respectively set said one of said first set of numbers, said one of said second set of numbers, and said one of said gain data.

8. The apparatus of claim 7, wherein said controller controls said rotating speed of said optical scanning system driving motor in synchronism with said predetermined elapsed time, when said frequency period, divided by said divider, is longer than said predetermined elapsed time after said first setting unit, said second setting unit, and said third setting unit respectively set said one of said first set of numbers, said one of said second set of numbers, and said one of said gain data.

9. The apparatus of claim 1, wherein:

said second memory stores said second set of numbers stepwisely corresponding to an elapsed time after a start of rotation of said optical scanning system driving motor; and said second setting unit reads said one of said second set of numbers according to an elapsed time after a start of rotation of said optical scanning system driving motor.

10. The apparatus of claim 1, further comprising:

a third memory for storing a plurality of gain data for PID control; and a third setting unit for reading one of said gain data from said third memory and for setting said one of said gain data at every predetermined interval time while said optical scanning system driving motor is accelerating or decelerating; and wherein said controller controls said rotating speed of said optical scanning system driving motor according to said comparison result of said comparing unit and said one of said gain data set by said third setting unit.

11. The apparatus of claim 10, wherein:

said third memory means stores said gain data stepwisely corresponding to an elapsed time after a start of rotation of said optical scanning system driving motor; and said third setting unit reads said one of said gain data according to an elapsed time after a start of rotation of said optical canning system driving motor.

12. The apparatus of claim 11, wherein said first setting unit, said second setting unit, and said third setting means respectively set said one of said first set of numbers, said one of said second set of numbers, and said one of said gain data at a same predetermined elapsed time.

13. The apparatus of claim 10, wherein said first setting unit, said second setting unit, and said third setting means respectively set said one of said first set of numbers, said one of said second set of numbers, and said one of said gain data at a same predetermined elapsed time.

14. The apparatus of claim 13, wherein said controller controls said rotating speed of said optical scanning system driving motor in synchronism with a frequency period which is divided by said divider, after said first setting unit, said second setting unit, and said third setting unit respectively set said one of said first set of numbers, said one of said second set of numbers, and said one of said gain data.

15. The apparatus of claim 10, wherein said controller controls said rotating speed of said optical scanning system driving motor in synchronism with a frequency period which is divided by said divider, after said first setting unit, said second setting unit, and said third setting unit respectively set said one of said first set of numbers, said one of said second set of numbers, and said one of said gain data.

16. The apparatus of claim 14, wherein said controller controls said rotating speed of said optical scanning system driving motor in synchronism with said predetermined elapsed time, when said frequency period, divided by said divider, is longer than said predetermined elapsed time after said first setting unit, said second setting unit, and said third setting unit respectively set said one of said first set of numbers, said one of said second set of numbers, and said one of said gain data.

17. The apparatus of claim 10, wherein said controller controls said rotating speed of said optical scanning system driving motor in synchronism with said predetermined elapsed time, when said frequency period, divided by said divider, is longer than said predetermined elapsed time after said first setting unit, said second setting unit, and said third setting unit respectively set said one of said first set of numbers, said one of said second set of numbers, and said one of said gain data.

18. The apparatus of claim 4, wherein said first setting unit, said second setting unit, and said third setting means respectively set said one of said first set of numbers, said one of said second set of numbers, and said one of said gain data at a same predetermined elapsed time.

19. The apparatus of claim 4, wherein said controller controls said rotating speed of said optical scanning system driving motor in synchronism with a frequency period which is divided by said divider, after said first setting unit, said second setting unit, and said third setting unit respectively set said one of said first set of numbers, said one of said second set of numbers, and said one of said gain data.

20. The apparatus of claim 4, wherein said controller controls said rotating speed of said optical scanning system driving motor in synchronism with said predetermined elapsed time, when said frequency period, divided by said divider, is longer than said predetermined elapsed time after said first setting unit, said second setting unit, and said third setting unit respectively set said one of said first set of numbers, said one of said second set of numbers, and said one of said gain data.

* * * * *